US009152118B2

(12) United States Patent
Nakura et al.

(10) Patent No.: US 9,152,118 B2
(45) Date of Patent: Oct. 6, 2015

(54) SHEET CONVEYING APPARATUS, IMAGE FORMING APPARATUS, SHEET CONVEYING DISTANCE CALCULATION APPARATUS AND SHEET LENGTH CALCULATION APPARATUS

(71) Applicants: Makoto Nakura, Ibaraki (JP); Takuro Kamiya, Kanagawa (JP); Shingo Takai, Ibaraki (JP); Naoto Ueda, Ibaraki (JP); Satoshi Ueda, Ibaraki (JP); Akira Kobashi, Ibaraki (JP); Koichi Kudo, Kanagawa (JP)

(72) Inventors: Makoto Nakura, Ibaraki (JP); Takuro Kamiya, Kanagawa (JP); Shingo Takai, Ibaraki (JP); Naoto Ueda, Ibaraki (JP); Satoshi Ueda, Ibaraki (JP); Akira Kobashi, Ibaraki (JP); Koichi Kudo, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/456,045

(22) Filed: Aug. 11, 2014

(65) Prior Publication Data

US 2014/0348563 A1 Nov. 27, 2014

Related U.S. Application Data

(63) Continuation of application No. 13/559,837, filed on Jul. 27, 2012, now Pat. No. 8,838,010.

(30) Foreign Application Priority Data

Aug. 5, 2011 (JP) ..... 2011-172318
May 30, 2012 (JP) ..... 2012-123115

(51) Int. Cl.

| | |
|---|---|
| ***G03G 15/01*** | (2006.01) |
| ***G03G 15/00*** | (2006.01) |
| ***B65H 5/06*** | (2006.01) |
| ***B65H 7/14*** | (2006.01) |
| ***G03G 15/16*** | (2006.01) |
| ***B65H 7/20*** | (2006.01) |
| ***B65H 7/06*** | (2006.01) |
| *G03G 15/23* | (2006.01) |

(52) U.S. Cl.

CPC ..... *G03G 15/6529* (2013.01); *B65H 5/06* (2013.01); *B65H 5/062* (2013.01); *B65H 7/06* (2013.01); *B65H 7/14* (2013.01); *B65H 7/20* (2013.01); *G03G 15/1615* (2013.01);

(Continued)

(58) Field of Classification Search

CPC ..... G03G 2215/00329; G03G 2215/00734; G03G 15/607

See application file for complete search history.

(56) References Cited

U.S. PATENT DOCUMENTS

2003/0175602 A1* 9/2003 Kazama ..... 430/22
2007/0025788 A1* 2/2007 deJong et al. ..... 399/388

(Continued)

FOREIGN PATENT DOCUMENTS

JP 2010-223848 10/2010
JP 2010-224336 10/2010

(Continued)

*Primary Examiner* — David Gray
*Assistant Examiner* — Sevan A Aydin
(74) *Attorney, Agent, or Firm* — IPUSA, PLLC

(57) ABSTRACT

A sheet conveying apparatus includes a sheet conveying unit that conveys a sheet including a drive roller, a driven roller, and a rotary encoder provided on a rotational axle of one of the drive roller and the driven roller; a conveying amount measuring unit that measures a conveying amount of the sheet; a first detection unit positioned downstream of the sheet conveying unit, the first detection unit being positioned apart from the drive roller and the driven roller not to overlap with the drive roller and the driven roller in the conveying direction; a second detection unit positioned upstream of the sheet conveying unit; and a conveying distance calculation unit that calculates a conveying distance of the sheet based on the measured result by the conveying amount measuring unit and the detected results detected by the first detection unit and the second detection unit.

17 Claims, 10 Drawing Sheets

(52) U.S. Cl.
CPC ..... *G03G 15/6561* (2013.01); *B65H 2511/11* (2013.01); *B65H 2511/33* (2013.01); *B65H 2513/50* (2013.01); *B65H 2553/51* (2013.01); *B65H 2701/1311* (2013.01); *B65H 2701/1313* (2013.01); *G03G 15/0189* (2013.01); *G03G 15/234* (2013.01)

(56) References Cited

U.S. PATENT DOCUMENTS

| | | | |
|---|---|---|---|
| 2010/0239282 | A1 | 9/2010 | Ashikawa et al. |
| 2010/0247115 | A1 | 9/2010 | Ohshima et al. |
| 2010/0310280 | A1 | 12/2010 | Kondo et al. |
| 2010/0329759 | A1 | 12/2010 | Furuya et al. |
| 2011/0020020 | A1 | 1/2011 | Ohshima et al. |
| 2011/0058828 | A1 | 3/2011 | Tsukamoto et al. |
| 2011/0064425 | A1 | 3/2011 | Kazama et al. |
| 2011/0076077 | A1 | 3/2011 | Morofuji et al. |

FOREIGN PATENT DOCUMENTS

| | | |
|---|---|---|
| JP | 2010-241600 | 10/2010 |
| JP | 2010-271407 | 12/2010 |
| JP | 2011-006202 | 1/2011 |
| JP | 2011-020842 | 2/2011 |
| JP | 2011-063332 | 3/2011 |
| JP | 2011-068460 | 4/2011 |
| JP | 2011-079662 | 4/2011 |

* cited by examiner

SHEET CONVEYING APPARATUS, IMAGE FORMING APPARATUS, SHEET CONVEYING DISTANCE CALCULATION APPARATUS AND SHEET LENGTH CALCULATION APPARATUS

CROSS-REFERENCE TO RELATED APPLICATIONS

This application is a continuation application of U.S. patent application Ser. No. 13/559,837 filed on Jul. 27, 2012, which claims the benefit of priority of Japanese Priority Application No. 2011-172318 filed on Aug. 5, 2011, and Japanese Priority Application No. 2012-123115 filed on May 30, 2012, where the entire contents of all of these applications are incorporated herein by reference.

BACKGROUND OF THE INVENTION

1. Field of the Invention

The present invention relates to a sheet conveying apparatus, an image forming apparatus, a sheet conveying distance calculation apparatus and a sheet length calculation apparatus.

2. Description of the Related Art

In a commercial printing business, Print on Demand (POD) by an image forming apparatus using electrophotography instead of using an offset printing machine has been provided for printing small lots of data, various types of data or variable data has been increasing. In order to meet this kind of need, registration on both surfaces is required for the image forming apparatus using electrophotography comparable to that of the offset printing machine.

There are two main reasons for causing a registration error occurring in both-sides printing, including registration error in the lateral and the vertical directions, and a skew error between a sheet and an image. Further, for an image forming apparatus including a heat fixing device, an image size error caused by expansion and contraction of the sheet is also a reason for registration error occurring in both-sides printing.

In order to automatically correct the registration error in both-sides printing caused by the image size error, it is required to use a technique to automatically and accurately measure the size of a sheet, the conveying distance of the sheet or the like. Thus, a technique to measure the length of the sheet by detecting passing of a front end and a rear end of the sheet and calculating the length of the sheet based on the period between the passing of the front end and the rear end of the sheet, or the like is known.

In Patent Document 1, a length measuring means for measuring a length of an object to be transferred is disclosed. The length measuring means includes a rotating member that conveys the object to be transferred, a passing detection means that detects passing of the object to be transferred, a rotating amount measurement means that measures a rotating amount of the rotating member and a speed detection means that detects conveying speed of the object to be transferred. The length measuring means measures the length of an object to be transferred based on the rotating amount of the rotating member and the conveying speed of the object to be transferred.

According to Patent Document 1, it is described that the length of the object to be transferred can be measured by the length measuring means without being influenced by the decentering of a conveying roller or variance of diameter of the conveying roller.

In Patent Document 2, a sheet length measurement apparatus for measuring a length of a paper is disclosed. The sheet length measurement apparatus includes a length measuring roller, an upstream edge sensor and a downstream edge sensor respectively provided at upstream and downstream of the length measuring roller for detecting the position of the paper, and conveying rollers respectively provided between the length measuring roller and the upstream edge sensor and between the length measuring roller and the downstream edge sensor. The sheet length measurement apparatus measures the length of the paper based on the rotating amount of the length measuring roller.

According to Patent Document 2, it is described that looseness of the paper can be prevented from being generated by the conveying rollers so that the length of the paper can be measured based on the rotating amount of the length measuring roller which is being rotated while contacting the paper, by the sheet length measurement apparatus.

In Patent Document 3, a sheet length measurement apparatus that measures a length of a recording sheet is disclosed. The sheet length measurement apparatus includes a length measuring roller which is being rotated in accordance with the movement of a paper by contacting the paper which is being conveyed on a conveying path, an encoder device that detects a rotating amount of the length measuring roller, and an opposing roller which is positioned to face the length measuring roller such that the length measuring roller is rotated in accordance with the movement of the paper.

According to Patent Document 3, it is described that the length measuring roller is surely rotated in accordance with the conveying movement of the paper, and the sheet length can be measured by the sheet length measurement apparatus.

However, for the length measuring means disclosed in Patent Document 1, the speed detection means for detecting the conveying speed of the object to be transferred is necessary so that the structure of the apparatus becomes complicated.

For the sheet length measurement apparatus disclosed in Patent Document 2 or Patent Document 3, the conveying rollers are provided upstream and downstream of the length measuring roller on the conveying path of the recording sheet to cause the structure of the apparatus to be complicated. Further, as the length measuring roller does not have a driving force, there may be a case where slipping, looseness or the like is generated between the recording sheet and the length measuring roller so that it is not possible to accurately measure the sheet length.

PATENT DOCUMENT

[Patent Document 1] Japanese Laid-open Patent Publication No. 2010-241600

[Patent Document 2] Japanese Laid-open Patent Publication No. 2011-006202

[Patent Document 3] Japanese Laid-open Patent Publication No. 2011-020842

SUMMARY OF THE INVENTION

The present invention is made in light of the above problems, and provides a sheet conveying apparatus capable of accurately obtaining the conveying distance of a sheet with a simple structure.

According to an embodiment, there is provided a sheet conveying apparatus including a sheet conveying unit that conveys a sheet including a drive roller which is driven to be rotated by a driving unit, a driven roller which is rotated in accordance with the drive roller while the sheet is interposed between the drive roller and the driven roller, and a rotary encoder provided on a rotational axle of one of the drive roller and the driven roller; a conveying amount measuring unit that measures a conveying amount of the sheet conveyed by the sheet conveying unit by measuring the number of pulses generated by the rotary encoder as a rotation amount; a first detection unit positioned downstream of the sheet conveying unit and detecting passing of a front end portion of the sheet downstream of the sheet conveying unit in a conveying direction of the sheet, the first detection unit being positioned apart from the drive roller and the driven roller not to overlap with the drive roller and the driven roller in the conveying direction; a second detection unit positioned upstream of the sheet conveying unit and detecting passing of a rear end portion of the sheet upstream of the sheet conveying unit in the conveying direction of the sheet; and a conveying distance calculation unit that calculates a conveying distance of the sheet based on the measured result by the conveying amount measuring unit and the detected results detected by the first detection unit and the second detection unit.

Note that also arbitrary combinations of the above-described constituents, and any exchanges of expressions in the present invention, made among method, device, system, recording medium, computer program and so forth, are valid as embodiments of the present invention.

BRIEF DESCRIPTION OF THE DRAWINGS

Other objects, features and advantages of the present invention will become more apparent from the following detailed description when read in conjunction with the accompanying drawings.

DETAILED DESCRIPTION OF THE PREFERRED EMBODIMENTS

Figure 1:
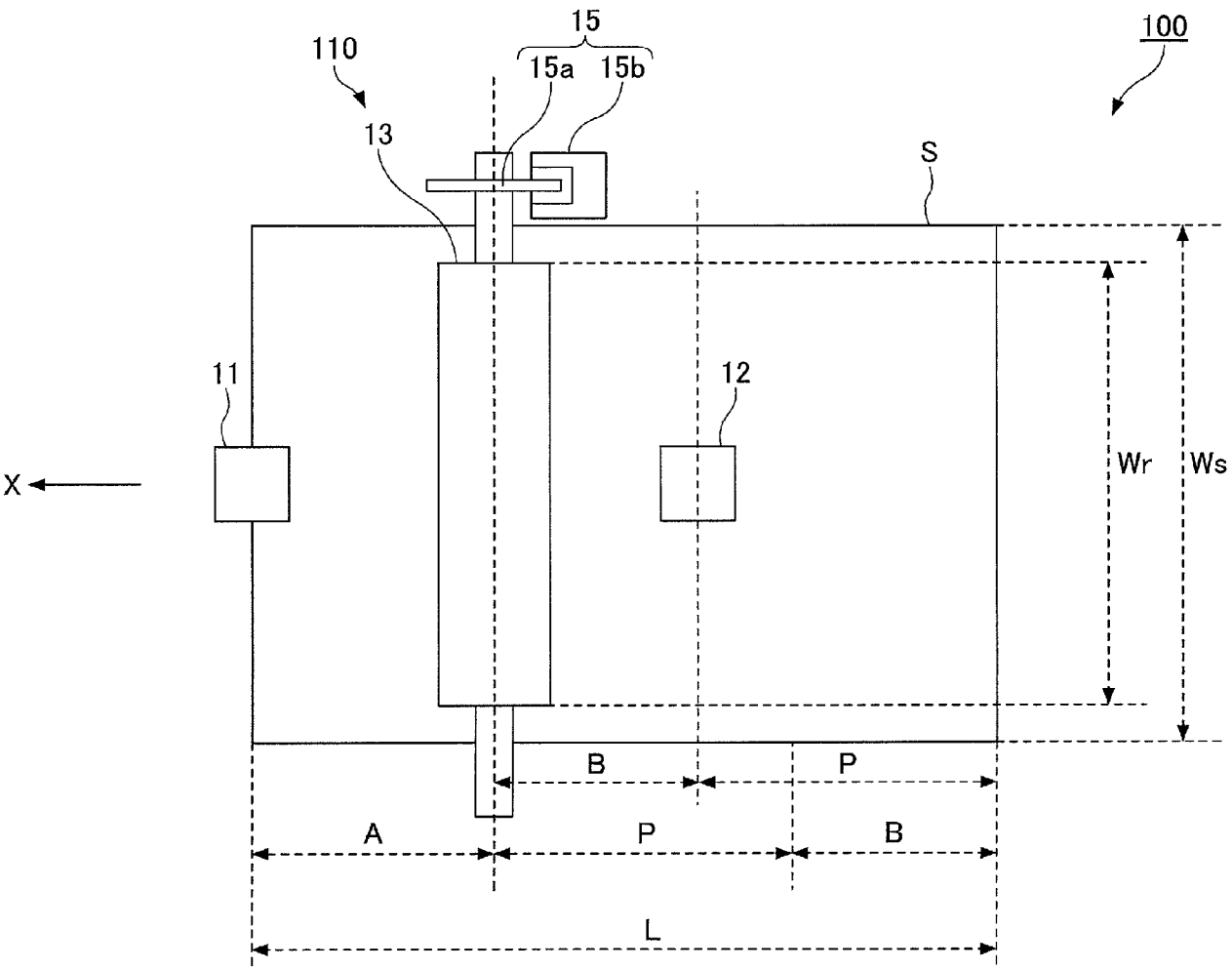
FIG. 1 a plan view schematically showing an example of a structure of a sheet conveying apparatus of an embodiment.

The invention will be described herein with reference to illustrative embodiments. Those skilled in the art will recognize that many alternative embodiments can be accomplished using the teachings of the present invention and that the invention is not limited to the embodiments illustrated for explanatory purposes.

It is to be noted that, in the explanation of the drawings, the same components are given the same reference numerals, and explanations are not repeated.

(Structure of Sheet Conveying Apparatus)

Figure 2:
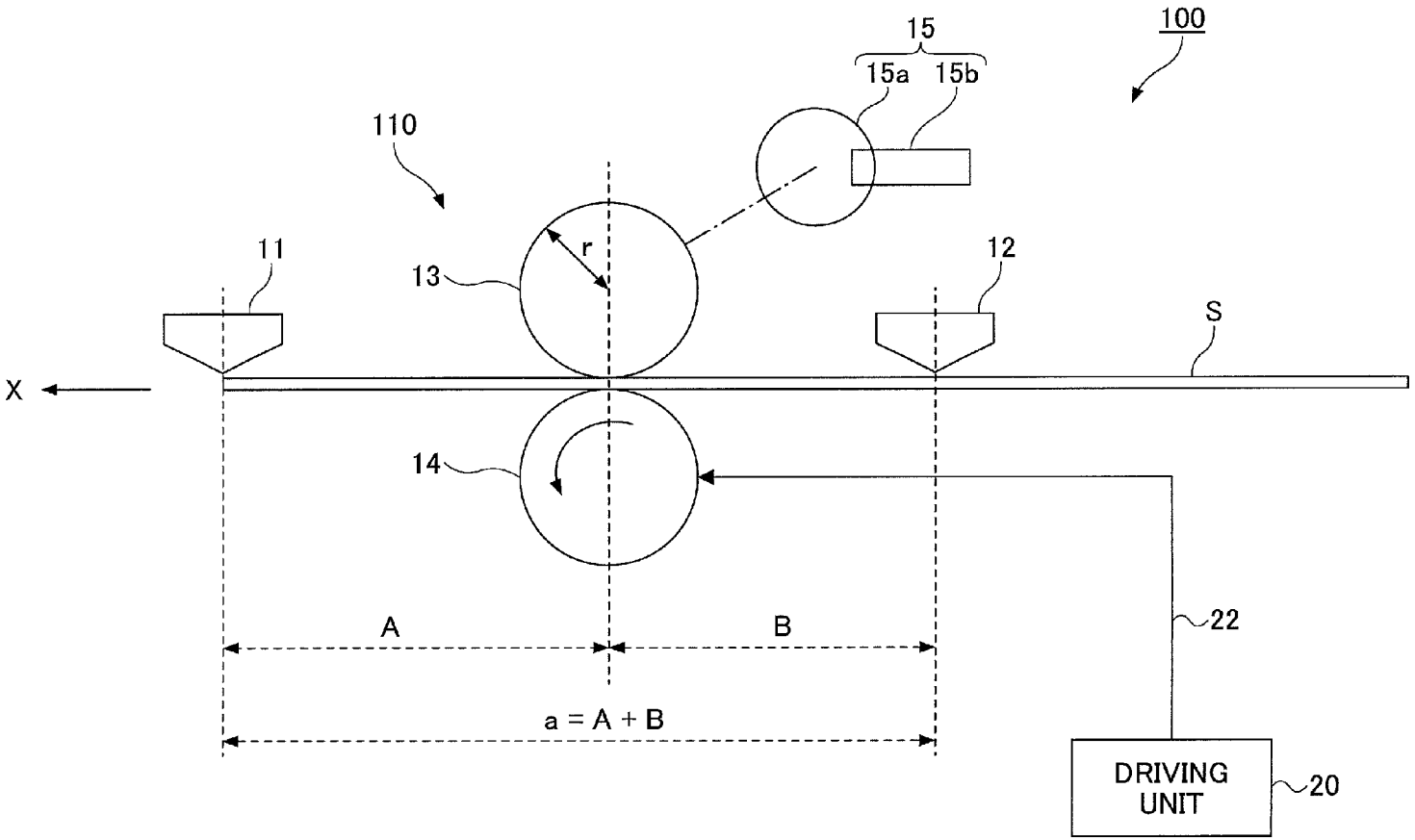
FIG. 2 is a cross-sectional view schematically showing an example of a structure of a sheet conveying apparatus of an embodiment.

FIG. 1 and FIG. 2 are views showing an outline constitution of a sheet conveying apparatus 100 of the embodiment. FIG. 1 is a plan view schematically showing an example of a structure of the sheet conveying apparatus 100 and FIG. 2 is a cross-sectional view schematically showing an example of a structure of the sheet conveying apparatus 100.

The sheet conveying apparatus 100 includes a sheet conveying unit 110 provided on a conveying path of a sheet S, a start trigger sensor 11, a stop trigger sensor 12, and a rotary encoder 15. The sheet S may be a paper, an OHP or the like. The sheet conveying unit 110 includes a drive roller 14 and a driven roller 13. The drive roller 14 is driven to be rotated by a driving unit 20 (see FIG. 2) such as a motor or the like and a driving force transmitting unit 22 (see FIG. 2) such as a gear, a belt or the like. The driven roller 13 is rotated in accordance with the rotation of the drive roller 14 while a sheet S is interposed between the drive roller 14 and the driven roller 13.

Figure 3:
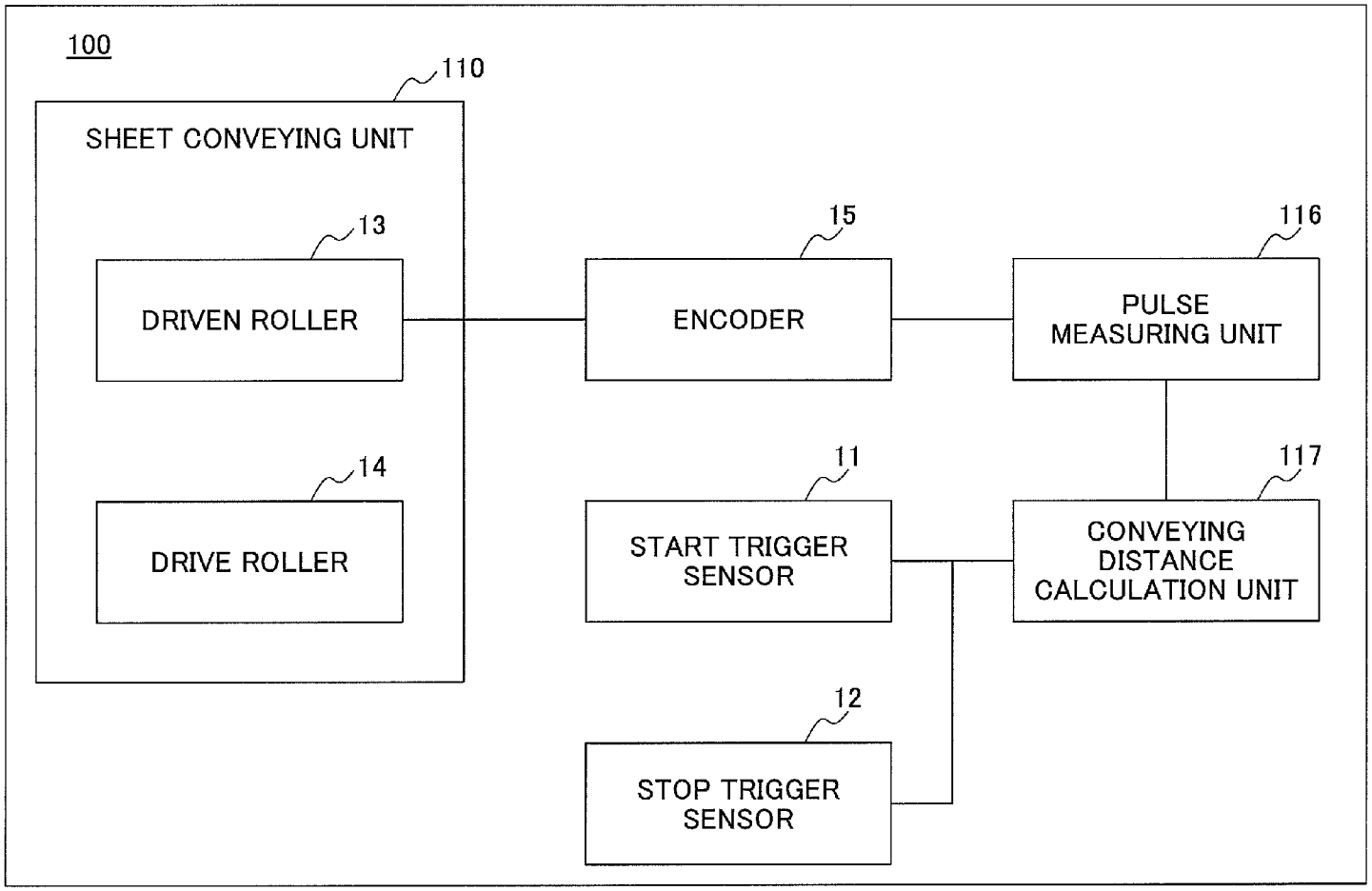
FIG. 3 is a block diagram showing an example of a functional structure of a sheet conveying apparatus of an embodiment.

FIG. 3 is a block diagram showing an example of a functional structure of the sheet conveying apparatus 100 of the embodiment.

As shown in FIG. 3, the sheet conveying apparatus 100 includes the sheet conveying unit 110 (the driven roller 13 and the drive roller 14), the rotary encoder 15, the start trigger sensor 11, the stop trigger sensor 12, a pulse measuring unit 116 and a conveying distance calculation unit 117. The structure of the sheet conveying apparatus 100 is explained with reference to FIG. 1 to FIG. 3.

The drive roller 14 includes an elastic layer at a surface in order to generate a sufficient friction force with the sheet S so that the sheet S becomes intervened between the drive roller 14 and the driven roller 13.

The driven roller 13 is provided to be pushed by a pushing member (not shown in the drawings) such as a spring or the like to be in contact with the drive roller 14. With this structure, when the drive roller 14 is rotated to convey the sheet S, the driven roller 13 is also rotated by the friction force generated with the sheet S.

The rotary encoder 15 is provided at a rotational axle of the driven roller 13 in this embodiment. The rotary encoder 15 includes an encoder disk 15*a* mounted on the rotational axle and an encoder sensor 15*b*. The encoder sensor 15*b* generates a pulse signal when the encoder disk 15*a* is being rotated with the driven roller 13.

The pulse measuring unit 116, which is an example of a conveying amount measuring unit, measures a rotation amount of the driven roller 13 as a conveying amount of the sheet S based on counting the pulse signal generated by the encoder sensor 15*b* in accordance with the rotation of the encoder disk 15*a*.

Alternatively, the rotary encoder 15 may be provided at a rotational axle of the drive roller 14, it means that the encoder disk 15*a* is mounted on the rotational axle. The diameter of a roller (the driven roller 13 or the drive roller 14) to which the rotary encoder 15 is provided may be as small as possible so that the number of rotations of the roller in accordance with the conveying amount of the sheet S becomes larger to accurately measure the conveying distance of the sheet S.

The driven roller 13 or the drive roller 14 to which the rotary encoder 15 is provided may be made of metal in order to reduce deflection of the rotational axle. By reducing the deflection of the rotational axle, the conveying distance of the sheet S, which will be explained later, can be accurately measured.

As shown in FIG. 1, the width "Wr" of the driven roller 13 is set to be smaller than the minimum width "Ws" of an expected sheet S adaptable to the sheet conveying apparatus 100, in a direction perpendicular to a conveying direction of the sheet S. Thus, when conveying the sheet S, the driven roller 13 does not directly contact the drive roller 14 so that the driven roller 13 can be rotated by the friction force generated with the sheet S. Therefore, the conveying distance of the sheet S can be accurately measured without being influenced by the drive roller 14.

The start trigger sensor 11 and the stop trigger sensor 12 are provided downstream and upstream, respectively, of the driven roller 13 and the drive roller 14 on a conveying path of the sheet S. The start trigger sensor 11 and the stop trigger sensor 12 are configured to detect passing of a front end portion (front edge) of the sheet S and passing of a rear end portion (rear edge) of the sheet, respectively. Each of the start trigger sensor 11 and the stop trigger sensor 12 may be a transmission or reflection optical sensor capable of detecting an end portion of the sheet S with high accuracy. In this embodiment, the start trigger sensor 11 and the stop trigger sensor 12 are reflection optical sensors.

The start trigger sensor 11 is an example of a first detection unit that detects passing of the front end portion of the sheet S. The stop trigger sensor 12 is an example of a second detection unit that detects passing of the rear end portion of the sheet S.

The start trigger sensor 11 and the stop trigger sensor 12 are positioned to be substantially at the same position in a direction perpendicular to the conveying direction of the sheet S. With this structure, it becomes possible to more precisely measure the conveying distance of the sheet S by minimizing the influence of the attitude of the sheet S (skew with respect to the conveyance direction).

In this embodiment, it is assumed that the distance between the start trigger sensor 11 and the driven roller 13 (or the drive roller 14) is "A", and the distance between the stop trigger sensor 12 and the driven roller 13 (or the drive roller 14) is "B", in the conveying direction of the sheet S. The distances "A" and "B" will be further explained later.

In this embodiment, it is assumed that the drive roller 14 is rotated in a direction shown by an arrow in FIG. 2. The driven roller 13 is rotated with respect to the drive roller 14 by the drive roller 14 when the sheet S is not conveyed (at an idling time) and by the sheet S when the sheet S is conveyed. When the driven roller 13 is rotated, the pulse signal is generated from the rotary encoder 15 provided at the rotational axle of the driven roller 13.

The pulse measuring unit 116 starts counting the number of pulses of the rotary encoder 15 based on the pulse signal when the start trigger sensor 11 detects passing of the front end portion of the sheet S, and stops counting the number of pulses of the rotary encoder 15 when the stop trigger sensor 12 detects passing of the rear end portion of the sheet S while the sheet S is being conveyed in a direction shown by an arrow X.

The conveying distance calculation unit 117 calculates the conveying distance of the sheet S by the sheet conveying unit 110 based on the detection of the sheet S by the start trigger sensor 11 and the stop trigger sensor 12, and the rotation amount of the driven roller 13 measured by the pulse measuring unit 116.

Alternatively, the driven roller 13 and the drive roller 14 may be oppositely positioned. Furthermore, as shown in FIG. 8, the driven roller 13 and the drive roller 14 may include plural parts separated in the direction perpendicular to the conveying direction of the sheet S, respectively.

Figure 8:
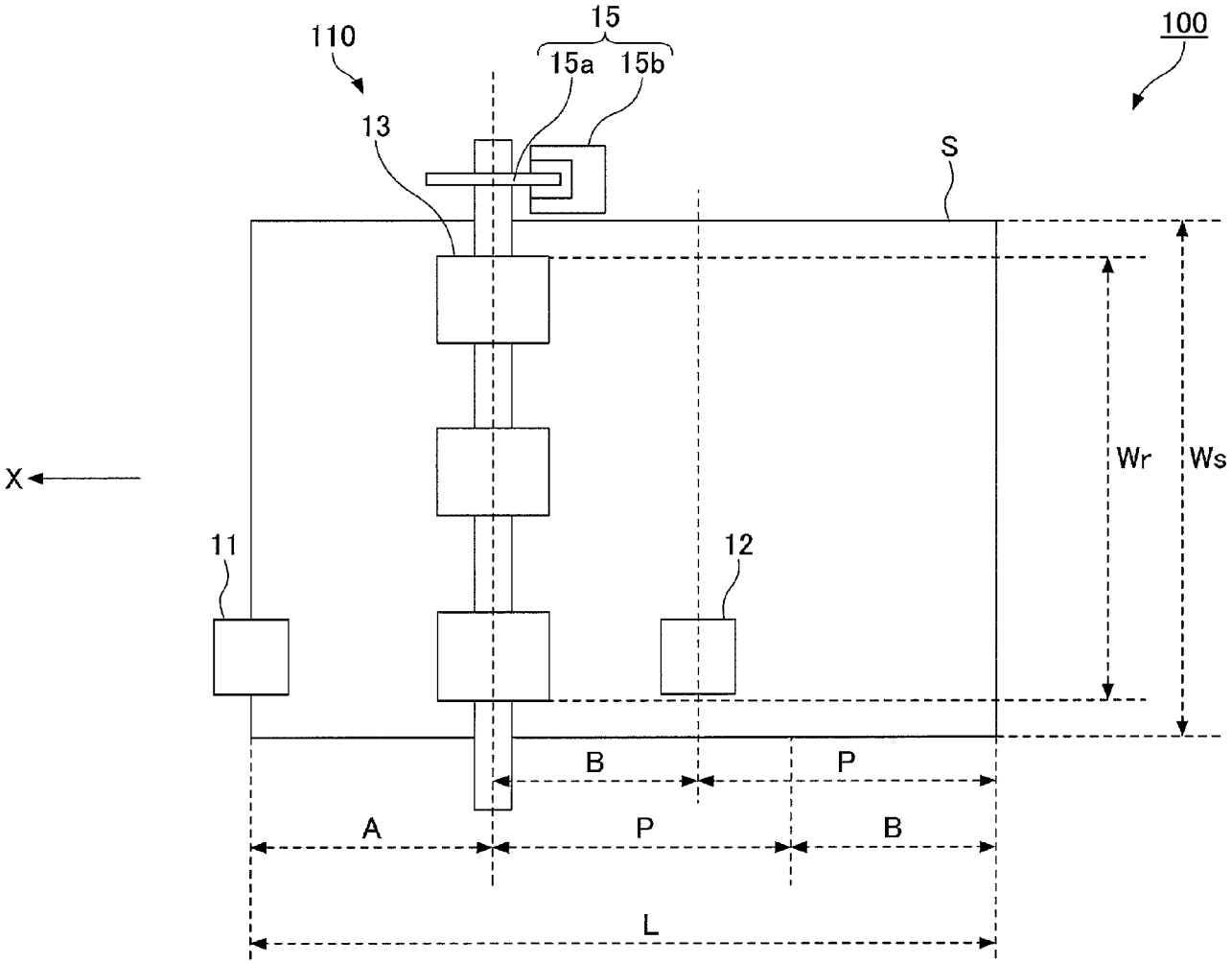
FIG. 8 is a block diagram showing another example of a sheet conveying apparatus of an embodiment.

Furthermore, the start trigger sensor 11 and the stop trigger sensor 12 are not necessarily positioned in the middle but may be positioned at an outer portion in the direction perpendicular to the conveying direction of the sheet S provided that they are positioned within the path of the sheet S as shown in FIG. 8.

(Calculation of Conveying Distance of Sheet)

Next, calculation of the conveying distance of the sheet S in the sheet conveying apparatus 100 is explained.

Figure 4:
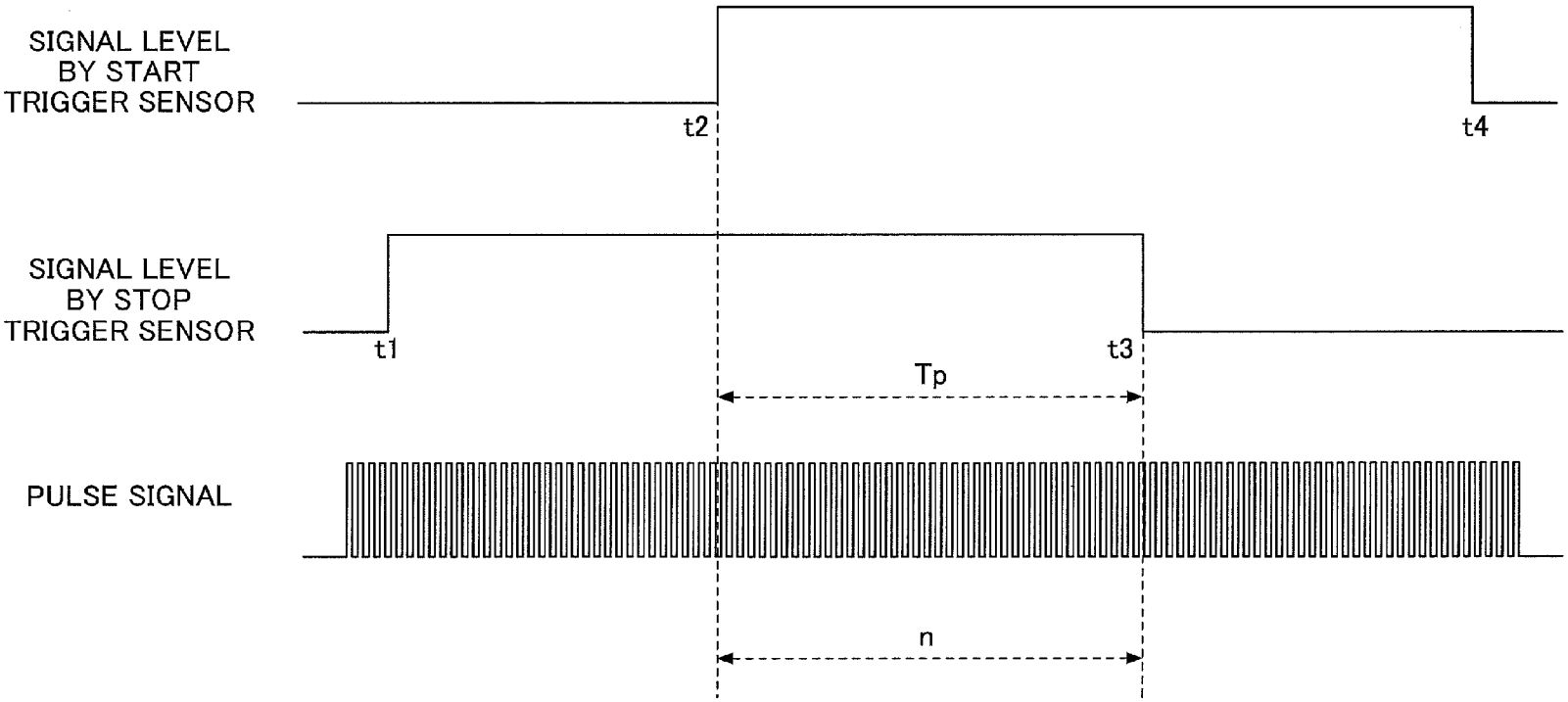
FIG. 4 is a view showing output signals output by a start trigger sensor, a stop trigger sensor and a rotary encoder.

FIG. 4 is a view showing output signals output by the start trigger sensor 11, the stop trigger sensor 12 and the rotary encoder 15.

As described above, when the driven roller 13 is rotated, the pulse signal is generated from the rotary encoder 15 which is provided at the rotational axle of the driven roller 13.

It is assumed that the stop trigger sensor 12 detects passing of a front end portion of the sheet S at time "t1" and after that, the start trigger sensor 11 detects passing of the front end portion of the sheet S at time "t2" while the sheet S is being conveyed.

Subsequently, it is assumed that the stop trigger sensor 12 detects passing of a rear end portion of the sheet S at time "t3" and after that, the start trigger sensor 11 detects passing of the rear end portion of the sheet S at time "t4".

The pulse measuring unit 116 counts the number of pulses of the rotary encoder 15 at a pulse counting period "Tp", which is from time "t2" at which the start trigger sensor 11 detects that the front end portion of the sheet S passes to time "t3" at which the stop trigger sensor 12 detects that the rear end portion of the sheet S passes.

Here, it is assumed that a radius of the driven roller 13 to which the rotary encoder 15 is provided is "r", the number of pulses of the rotary encoder 15 while the driven roller 13 is rotated 360 degrees is "N", and the number of pulses counted by the pulse measuring unit 116 during the pulse counting period "Tp" is "n". Under this condition, the sheet conveying distance "P" (see FIG. 1) of the sheet S during the pulse counting period "Tp" (from time "t2" to time "t3") is expressed by the following equation (1).

$$P=(n/N)\times 2\pi r \quad (1)$$

n: the counted number of pulses

N: the number of pulses of the rotary encoder 15 while the driven roller 13 is rotated 360 degrees r: radius [mm] of the driven roller 13

Generally, a sheet conveying speed is easily varied based on mechanical accuracy such as structural accuracy of the rollers (especially the drive roller 14) which convey the sheet S, deflection of rotational axle or the like, rotational accuracy of the motor or the like, or accuracy of the driving force transmitting unit such as a gear, a belt or the like. Further, the sheet conveying speed is varied based on a slipping phenomenon between the drive roller 14 and the sheet S, looseness generated by the difference in conveying force or conveying speed of conveying units provided upstream or downstream of the sheet conveying unit 110 or the like. Thus, a pulse period or pulse width of the rotary encoder 15 may always vary. However, the number of pulses does not easily vary.

Thus, the conveying distance calculation unit 117 can accurately obtain the sheet conveying distance "P" of the sheet S conveyed by the driven roller 13 and the drive roller 14 in accordance with the above equation (1), without depending on the sheet conveying speed.

The conveying distance calculation unit 117 can further obtain a relative ratio of the conveying distances of a previous sheet S and a next sheet S, a relative ratio of the conveying distances of a front surface of the sheet S and a back surface of the sheet or the like.

The conveying distance calculation unit 117 may obtain a ratio of expansion and contraction "R" based on a relative ratio of the conveying distances before and after the heat fixing by electrophotography in accordance with the following equation (2).

$$R=[(n2/N)\times 2\pi r]/[(n1/N)\times 2\pi r] \quad (2)$$

n1: the number of pulses measured when the sheet S before the heat fixing is conveyed n2: the number of pulses measured when the sheet S after the heat fixing is conveyed Examples are explained in the following.

In this embodiment, when the measured number of pulses is n1=18816 under a condition that N=2800, r=9 mm and the sheet S of A3 size is conveyed in the longitudinal direction, the conveying distance "P1" of the sheet S becomes, $$P1=(18816/2800)\times 2\pi\times 9=380.00 \text{ mm}$$

Further, when the measured number of pulses is n2=18759 after the heat fixing of the sheet S, the conveying distance "P2" of the sheet S becomes, $$P2=(18759/2800)\times 2\pi\times 9=378.86 \text{ mm}$$

Thus, the difference between before and after the heat fixing ΔP of the conveying distances "P1" and "P2" of the sheet S becomes as follows.

$$\Delta P=380.00-378.86=1.14 \text{ mm}$$

Thus, the ratio of expansion and contraction "R" (the relative ratio between before and after the heat fixing (front side surface and back side surface of the sheet S, respectively)) of the sheet S may be obtained as follows.

$$R=378.86/380.00=99.70\%$$

Thus, in this case, the length of the sheet S in the conveying direction of the sheet S is shrunken about 1 mm by the heat fixing. Therefore, if the lengths of the images to be formed on the front surface and the back surface of the sheet S are the same, registration error between two surfaces of about 1 mm is generated. Thus, by correcting the length of the image printed on the back surface of the sheet S based on the calculated ratio of expansion and contraction "R", the registration in two-sided printing can be improved.

Here, for the above described example, the ratio of expansion and contraction "R" is obtained by calculating the conveying distances "P1" and "P2" of the sheet S before and after the heat fixing. Alternatively, the ratio of expansion and contraction "R" may be calculated based on the numbers of pulses "n1" and "n2" which are counted by the pulse measuring unit 116 such as R=n2/n1.

For the above example, when the number of pulses $n_1$, which is measured when the sheet S is conveyed before the heat fixing, is n1=18816, and the number of pulses n2, which is measured when the sheet S is conveyed after the heat fixing, is n2=18759, the ratio of expansion and contraction "R" may be obtained as follows.

$$R=n2/n1=18759/18816=99.70\%$$

Figure 5:
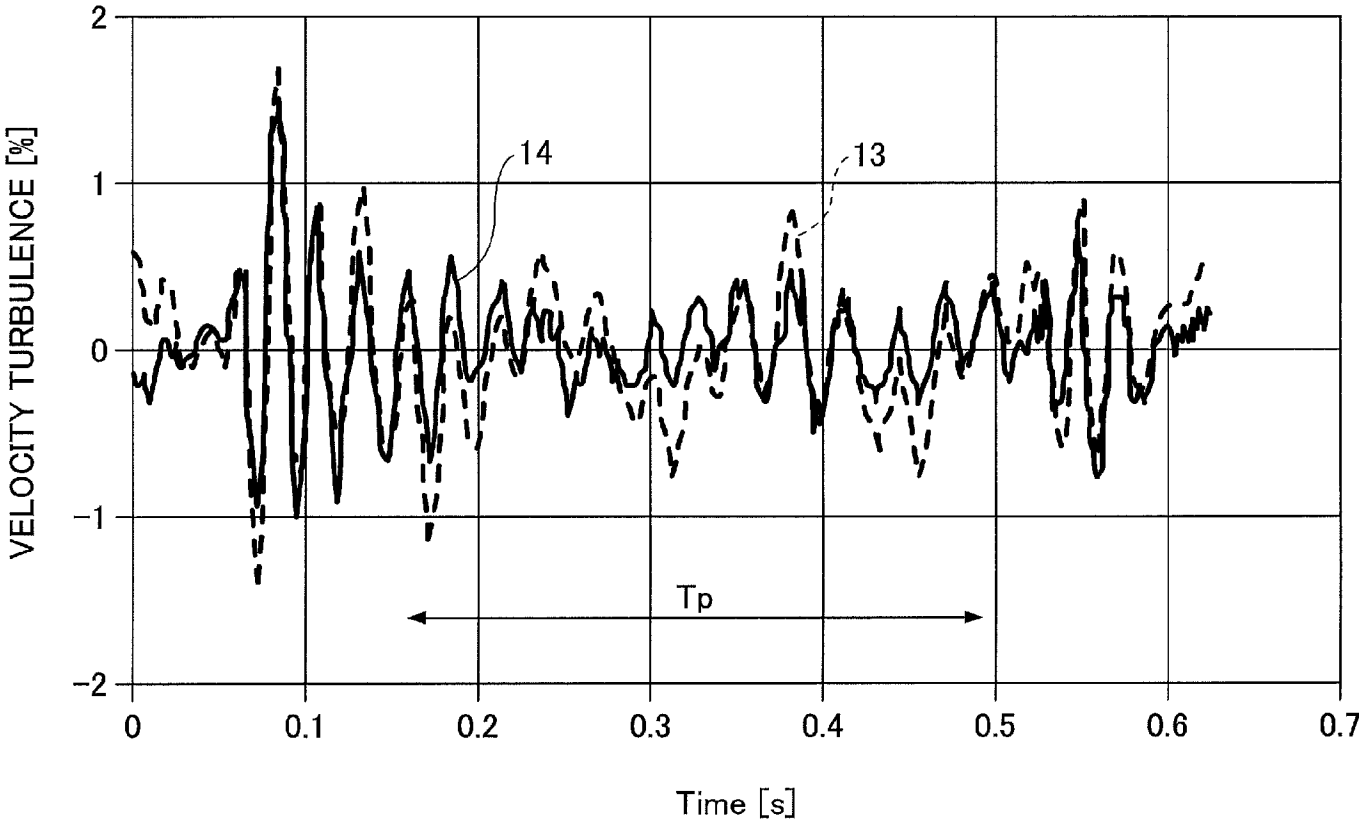
FIG. 5 is a graph showing velocity turbulences of a driven roller and a drive roller.

FIG. 5 shows an example of velocity turbulence of the drive roller 14 and the driven roller 13 when conveying the sheet S.

FIG. 5 is a graph showing velocity turbulences of the driven roller 13 and the drive roller 14 when the sheet S is inserted between the driven roller 13 and the drive roller 14 while being conveyed and passed. In the graph, the axis of abscissa expresses time and the axis of ordinate expresses velocity turbulences of the driven roller 13 and the drive roller 14.

As can be understood from the graph, the velocity turbulences of the driven roller 13 and the drive roller 14 become large at time about 0.06 seconds at which the sheet S is inserted between the driven roller 13 and the drive roller 14 and about 0.54 seconds at which the sheet S is removed from the driven roller 13 and the drive roller 14. Especially, at a period about 0.05 seconds after the sheet S is inserted between the driven roller 13 and the drive roller 14, the velocity turbulences of the driven roller 13 and the drive roller 14 become much larger. The velocity turbulences are generated in accordance with the resonance frequencies of the driven roller 13 and the drive roller 14 caused when the sheet S contacts the driven roller 13 and the drive roller 14 and converge after a predetermined period.

These velocity turbulences cause an error in measuring the conveying amount by the rotary encoder 15 provided at the rotational axle of the driven roller 13 (or the drive roller 14). Thus, if the pulses are counted while the velocity turbulence is generated by the insertion of the sheet S, it is not possible to accurately measure the conveying distance "P" of the sheet S. Thus, according to the embodiment, the pulse measuring unit 116 starts counting the pulses after a predetermined period has passed after the sheet S is inserted between the driven roller 13 and the drive roller 14.

Generally, it requires a period about three times of the resonance frequency for converging the velocity turbulences after the velocity turbulence is generated in accordance with the resonance frequency.

Thus, the distance "A" between the start trigger sensor 11 and the driven roller 13 (or the drive roller 14) shown in FIG. 1, is set to be larger than three times of a value obtained by dividing the conveying speed of the sheet S by the resonance frequency of the driven roller 13 or the drive roller 14. Here, the resonance frequency of the driven roller 13 or the drive roller 14 is about tens Hz.

Thus, for example, when the resonance frequency of the driven roller 13 or the drive roller 14 is 50 Hz, and the conveying speed of the sheet S is 500 mm/s, the distance "A" is set as follows.

$$A>1/50\times 3\times 500=30 \text{ mm}$$

Thus, by setting the distance "A" between the start trigger sensor 11 and the driven roller 13 (or the drive roller 14) on the conveying path of the sheet S larger than 30 mm, the conveying distance "P" can be accurately measured without being influenced by the velocity turbulence caused by the insertion of the sheet S.

Further, the stop trigger sensor 12 is positioned such that the distance "B" between the stop trigger sensor 12 and the driven roller 13 (or the drive roller 14) becomes as short as possible. The reason is explained in the following.

As explained above, the number of pulses is counted by the pulse measuring unit 116 at the pulse counting period "Tp", which is from time "t2" at which the start trigger sensor 11 detects that the front end portion of the sheet S passes and to time "t3" at which the stop trigger sensor 12 detects that the rear end portion of the sheet S passes. Thus, as shown in FIG. 1 and FIG. 2, when it is assumed that a length of the sheet S in the conveying direction is "L", the conveying distance "P" can be expressed as $$P=L-a$$

where "a" is a distance between the start trigger sensor 11 and the stop trigger sensor 12 (a=A+B).

Thus, the stop trigger sensor 12 is positioned as far downstream as possible so that the distance "B" becomes shorter and the conveying distance "P" becomes longer to improve accuracy in calculation.

Further, by using the relationship expressed in the equation (1), the length "L" of the sheet S in the conveying direction is can be expressed as follows.

$$L=(n/N)\times 2\pi r+a \quad (3)$$

a: the distance between the start trigger sensor 11 and the stop trigger sensor 12

The conveying distance calculation unit 117 of the sheet conveying apparatus 100 can obtain the length "L" of the sheet S in the conveying direction based on the equation (3) in which the distance "a" between the start trigger sensor 11 and the stop trigger sensor 12 is added to the conveying distance "P" of the sheet S obtained based on the above equation (1).

Further, the conveying distance calculation unit 117 can obtain the ratio of expansion and contraction "R" from the relative ratio of the length "L" of the sheet S in the conveying direction before and after the heat fixing by the electrophotography in accordance with the following equation (4).

$$R=[(n2/N)\times 2\pi r+a]/[(n1/N)\times 2\pi r+a] \quad (4)$$

As described above, the conveying distance calculation unit 117 can accurately obtain the length "L" of the sheet S in the conveying direction and the ratio of expansion and contraction "R".

(Structure of Image Forming Apparatus)

Figure 9:
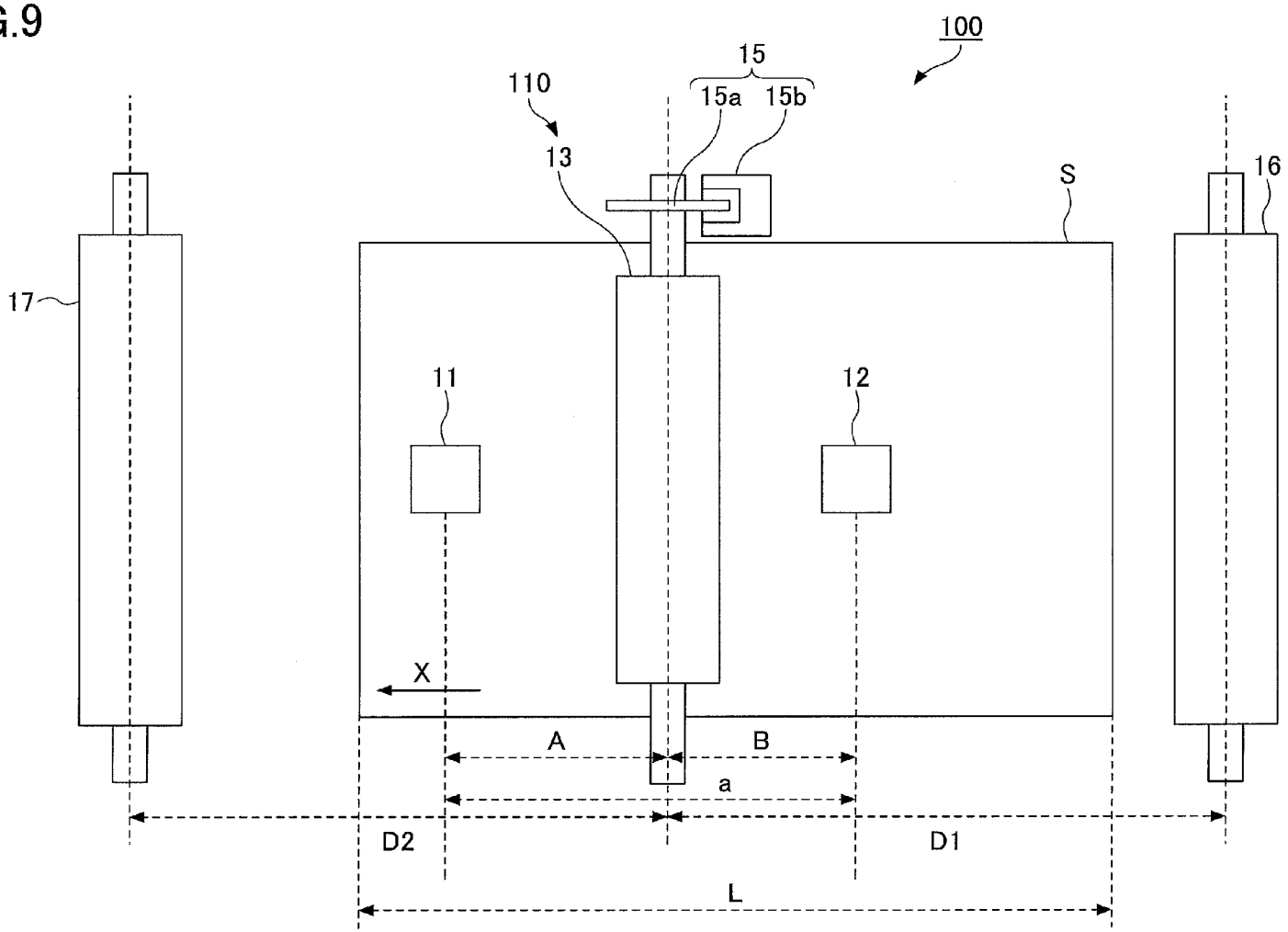
FIG. 9 is a plan view schematically showing another example of a sheet conveying apparatus of an embodiment.

FIG. 9 is a view showing a positional relationship between the driven roller 13 of the sheet conveying apparatus 100, a first conveying unit 16 and a second conveying unit 17.

The first conveying unit 16 and the second conveying unit 17 are provided upstream and downstream of the sheet conveying unit 110 on the conveying path of the sheet S, respectively. The first conveying unit 16 passes the sheet S to the sheet conveying unit 110 (the driven roller 13 and the drive roller 14) and then the sheet S is further passed to the second conveying unit 17. The first conveying unit 16 and the second conveying unit 17 may be components of an image forming apparatus including the sheet conveying apparatus 100.

It is assumed that a first distance between the first conveying unit 16 and the sheet conveying unit 110 (the driven roller 13 and the drive roller 14) is "D1", and a second distance between the second conveying unit 17 and the sheet conveying unit 110 (the driven roller 13 and the drive roller 14) is "D2". At this time, it is necessary to set the first distance "D1" and the second distance "D2" to be shorter than a minimum length "Lmin" of an expected sheet S adaptable to the sheet conveying apparatus 100 in order to pass the sheet S between the first conveying unit 16 and the sheet conveying unit 110, and between the sheet conveying unit 110 and the second conveying unit 17, respectively.

Further, if the sheet S is conveyed by all of the first conveying unit 16, the sheet conveying unit 110, and the second conveying unit 17 at the same time, looseness may easily occur on the sheet S because of the difference in conveying speeds. Therefore, the sheet S may be conveyed by two of the first conveying unit 16, the sheet conveying unit 110, and the second conveying unit 17, in other words, between the first conveying unit 16 and the sheet conveying unit 110, or between the sheet conveying unit 110 and the second conveying unit 17. For example, by setting the first distance "D1" and the second distance "D2" shown in FIG. 9 to be longer than ½ of the minimum length "Lmin" of the sheet S, the sheet S is conveyed by two of the first conveying unit 16, the sheet conveying unit 110, and the second conveying unit 17.

Further, the first conveying unit 16 may include two rollers opposing each other, and similarly, the second conveying unit 17 may include two rollers opposing each other. Further, a contact control mechanism may be provided that is configured to control one of the rollers of the first conveying unit 16 and/or one of the rollers of the second conveying unit 17 so that the rollers of the first conveying unit 16 and/or the rollers of the second conveying unit 17 are apart from each other while the conveying amount of the sheet S is being measured. For example, the contact control mechanism may be configured to control one of the rollers of the first conveying unit 16 after the sheet S is passed to the driven roller 13 and the drive roller 14 so that the rollers of the first conveying unit 16 are apart from each other. The contact control mechanism may include a solenoid or the like, for example.

In this embodiment, in order to reduce influence of velocity turbulence of a conveying unit other than that of the sheet conveying apparatus 100, such as the first conveying unit 16 or the second conveying unit 17 while the conveying amount of the sheet S is being measured, the sheet S may be conveyed only by the sheet conveying unit 110 when the conveying amount of the sheet S is being measured.

When the first conveying unit 16 and the second conveying unit 17 are formed to have structures same as that of the sheet conveying apparatus 100, including a drive roller and a driven roller to convey the sheet S while the sheet S is interposed therebetween, by using rollers having the same diameter or the width as the drive roller or the like, cost can be reduced.

Figure 6:
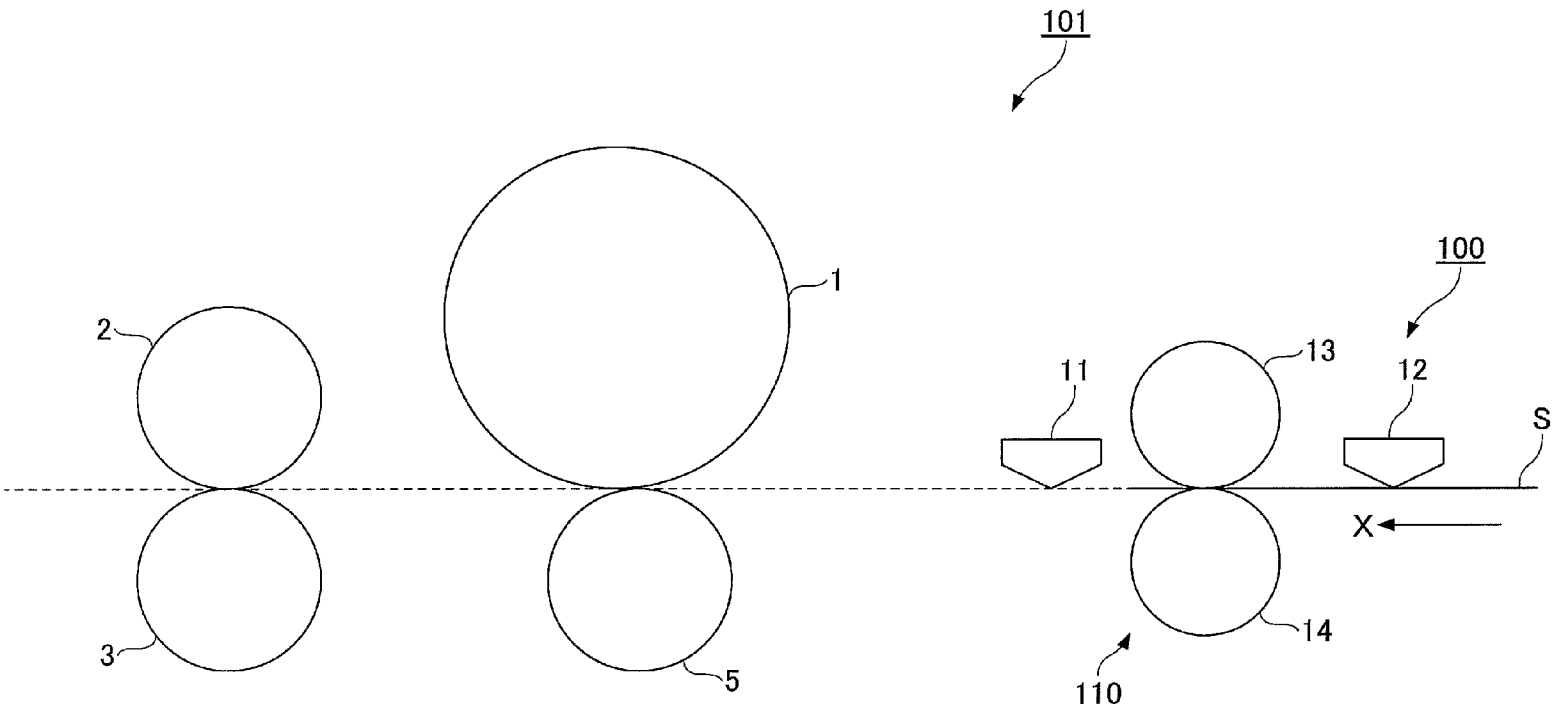
FIG. 6 is a schematic diagram showing an example of an image forming apparatus of an embodiment.
Figure 7:
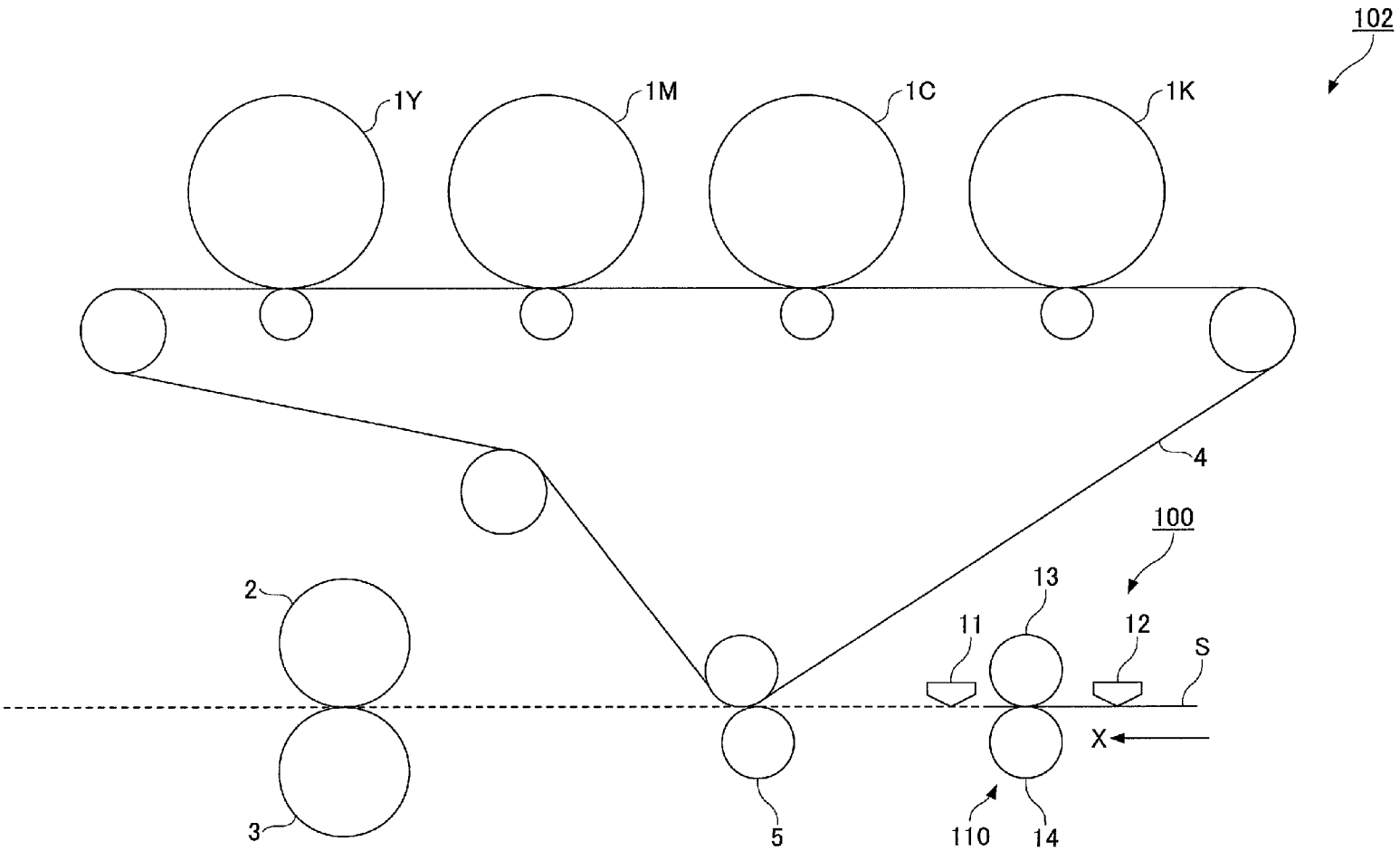
FIG. 7 is a schematic diagram showing an example of an image forming apparatus of an embodiment.

FIG. 6 and FIG. 7 are views schematically showing an example of an image forming apparatus including the sheet conveying apparatus 100. FIG. 6 shows an example of a monochrome image forming apparatus 101, and FIG. 7 shows an example of a tandem color image forming apparatus 102.

In the monochrome image forming apparatus 101 shown in FIG. 6, an image is printed on the conveyed sheet S as follows. First, a whole surface of a photoconductor drum 1 is charged while the photoconductor drum 1 is rotated. Then, an electrostatic latent image is formed on the surface of the photoconductor drum 1 by a light writing unit, not shown in the drawings. Then, the electrostatic latent image is developed to form a toner image by a developing unit, not shown in the drawings.

Subsequently, when the sheet S passes between the photoconductor drum 1 and a transfer unit 5, the toner image formed on the surface of the photoconductor drum 1 is transferred onto the sheet S. Thereafter, when the sheet S passes between a heat roller 2 and a pressure roller 3, the toner image is melted and fixed on the sheet S so that a printed image is formed on the sheet S. The photoconductor drum 1 and the transfer unit 5 may be an example of the second conveying unit 17 shown in FIG. 9.

In the tandem color image forming apparatus 102 shown in FIG. 7, an image is printed on the conveyed sheet S as follows. First, similar to the photoconductor drum 1 of the monochrome image forming apparatus 101, toner images formed on surfaces of photoconductor drums 1K, 1C, 1Y and 1M respectively provided for black (K), cyan (C), yellow (Y) and magenta (M) are primary transferred onto an intermediate transfer belt 4 in a superposed manner. Then, the superposed color toner image on the intermediate transfer belt 4 is secondary transferred onto the sheet S when the sheet S passes between the intermediate transfer belt 4 and the transfer unit 5.

The sheet S on which the color toner image is formed is further conveyed to pass between the heat roller 2 and the pressure roller 3 so that a printed image is formed on the sheet S.

For the image forming apparatuses 101 and 102 shown in FIG. 6 and FIG. 7, the sheet conveying apparatus 100 is placed right before (upstream of) the transfer unit 5 on the conveying path of the sheet S. Even for another image forming apparatus having a different structure, by placing the sheet conveying apparatus 100 right before (upstream of) a transfer unit, the conveying distance of the sheet S or the length of the sheet S in the conveying direction before transferring can be measured.

In the image forming apparatuses 101 and 102, first, the conveying distance of the sheet S is calculated by the sheet conveying apparatus 100. Then, a toner image is transferred on the sheet S by the transfer unit 5. Subsequently, when the sheet S is conveyed between the heat roller 2 and the pressure roller 3, a printed image is formed on one surface of the sheet S.

When printing images on both surfaces, the sheet S is reversed by a reverse mechanism, not shown in the drawings, and is conveyed again in a direction shown by an arrow X in FIG. 6 and FIG. 7. At this time, the sheet S is generally contracted by the heat so that the sheet S is conveyed under a condition that the size of the sheet S is changed. Then, the conveying distance is calculated by the sheet conveying apparatus 100 again, and a toner image is transferred and fixed on the back surface.

In this embodiment, the length of the toner image to be transferred on the back surface is corrected (image size correction is performed) based on the calculated relative ratio of the conveying distances before and after the heat fixing. Then, the corrected toner image is transferred on the back surface of the sheet S. Thus, the length of the images formed on the front surface and the back surface of the sheet S become the same to improve the registration in two-sided printing.

The contraction of the sheet S caused by the heat fixing recovers in accordance with time, thus, by measuring the conveying distance "P" right before the transfer unit 5, the length of the sheet S after the heat fixing can be accurately measured to improve the registration in two-sided printing.

By correcting the size of the image data or the timing of transferring the toner image on the sheet S based on the thus obtained conveying distance "P" of the sheet S or the length of the sheet S in the conveying distance, the registration error in two-sides printing caused by the expansion and contraction of the sheet S can be corrected to improve the registration in two-sided printing.

Further, the registration error caused by the variation in conveying speed when transferring the toner image onto the sheet S can be reduced by providing a torque control member or a conveying distance control member to the sheet conveying unit.

As described above, according to the image forming apparatuses 101 and 102 including the sheet conveying apparatus 100 of the embodiment, images can be printed on the sheet S with a higher registration in two-sided printing.

Further, in the above embodiment, the image forming apparatuses 101 and 102 form an image using electrophotography, the sheet conveying apparatus 100 may be provided in an image forming apparatus which forms an image using another method such as an ink-jet or the like.

Figure 10:
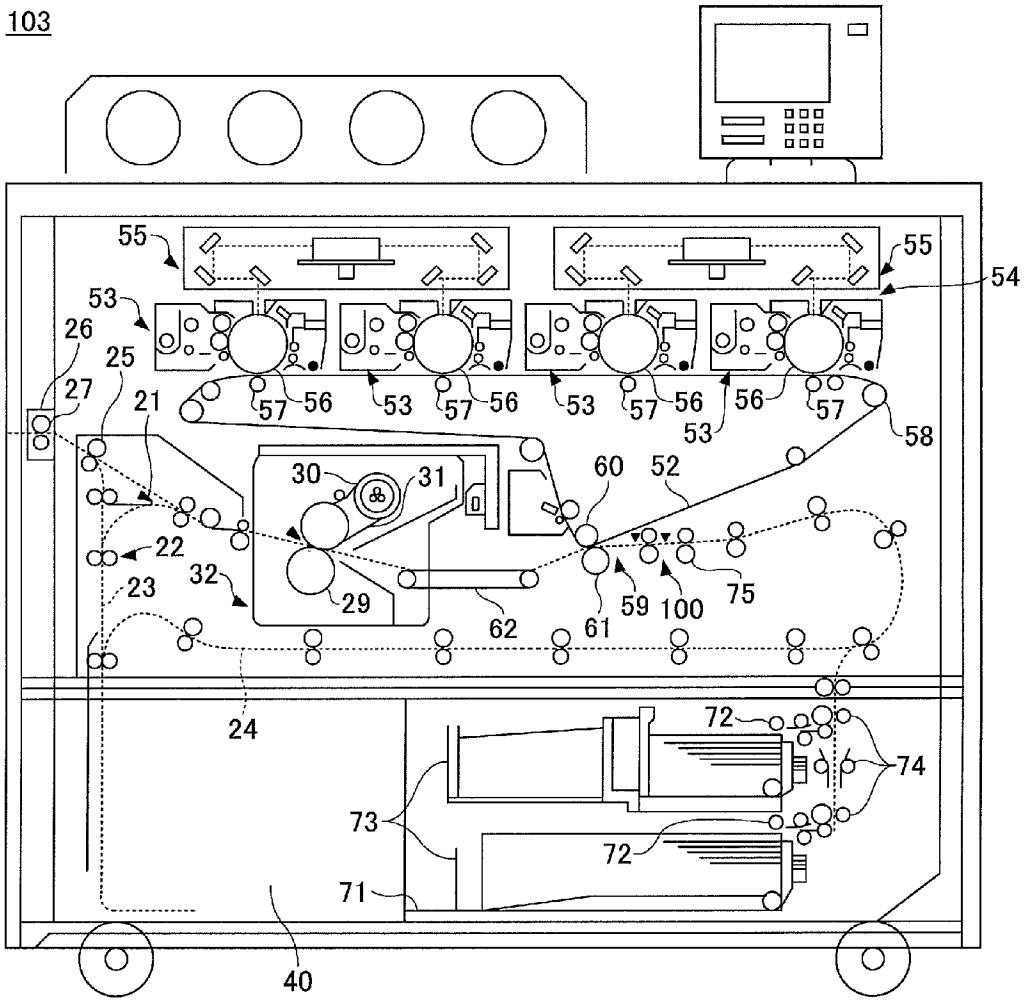
FIG. 10 is a schematic diagram showing an example of an image forming apparatus of an embodiment.

FIG. 10 is a view schematically showing an example of an image forming apparatus 103 including the sheet conveying apparatus 100.

The image forming apparatus 103 includes an intermediate transfer belt 52, a tandem image forming device 54, an exposure device 55, first transfer rollers 57, a second transfer device 59, the sheet conveying apparatus 100, a fixing device 32, a resist roller 75, a conveying belt 62, a feeding table 71, a de-curl unit 26 and a purge tray 40.

The intermediate transfer belt 52 is an endless belt and is provided at almost the center of the image forming apparatus 103. The intermediate transfer belt 52 is supported by plural support rollers 58 to be rotated in a clockwise direction in FIG. 10.

The tandem image forming device 54 includes plural image forming units 53 which are laterally aligned above the intermediate transfer belt 52 along the conveying direction of the transfer belt 52. The exposure device 55 is provided above the tandem image forming device 54.

Each of the image forming units 53 of the tandem image forming device 54 includes a photoconductor drum 56 as an image retaining member which retains a toner image of a respective color.

The first transfer rollers 57 are positioned to face the photoconductor drums 56 with the intermediate transfer belt 52 interposed therebetween at first transferring positions at which toner images are transferred to the intermediate transfer belt 52, respectively. The support rollers 58 function as drive rollers that rotate the intermediate transfer belt 52.

The second transfer device 59 is provided at an opposite side (downstream of the conveying direction of the intermediate transfer belt 52) of the tandem image forming device 54 while contacting the intermediate transfer belt 52. The second transfer device 59 includes a second transfer roller 61 and a second transfer opposing roller 60 which is facing the second transfer roller 61. The second transfer device 59 transfers a toner image formed on the intermediate transfer belt 52 onto the sheet S by pushing the second transfer roller 61 toward the second transfer opposing roller 60 while applying a transferring electric field. The second transfer device 59 varies the transferring current of the second transfer roller 61, which is a parameter for transferring, in accordance with the sheet S.

The sheet conveying apparatus 100 is provided upstream of the second transfer device 59 in the conveying direction of the sheet S. The fixing device 32 is provided downstream of the second transfer device 59 in the conveying direction of the sheet S. The fixing device 32 melts and fixes a toner image on the sheet S.

The sheet conveying apparatus 100 measures the conveying distance "P" of the sheet S or a length "L" of the sheet in the conveying direction of the sheet S before and after the sheet S passes the fixing device 32 in duplex printing. The image forming apparatus 103 corrects the size of the image to be formed on the back surface of the sheet S based on the ratio of expansion and contraction "R" which is calculated from the measured conveying distance "P" or the length "L" of the sheet S. Further, in this embodiment, the sheet conveying apparatus 100 is placed right before (upstream of) the second transfer device 59 and after (downstream of) the resist roller 75. Thus, the second transfer device 59 may be an example of the second conveying unit 17 and the resist roller 75 may be an example of the first conveying unit 16 shown in FIG. 9.

The fixing device 32 includes a pressure roller 29, a halogen lamp 30 as a heat source, and a fixing belt 31 which is an endless belt. The pressure roller 29 is pushed toward the fixing belt 31. The fixing device 32 changes a parameter for fixing such as temperatures of the fixing belt 31 and the pressure roller 29, a nip width between the fixing belt 31 and the pressure roller 29, and the speed of the pressure roller 29 in accordance with the sheet S. The sheet S on which the toner image is formed is conveyed to the fixing device 32 by the conveying belt 62.

When image data is sent to the image forming apparatus 103, and the image forming apparatus 103 receives a signal to start image formation, one of the support rollers 58 is rotated by a driving motor, not shown in the drawings, so that other support rollers 58 are also driven by the rotated support roller 58 to rotate and convey the intermediate transfer belt 52. At the same time, monochromatic images are formed on the respective photoconductor drums 56 of the image forming units 53. Then, the monochromatic images are transferred onto the intermediate transfer belt 52 by the first transfer rollers 57 while the intermediate transfer belt 52 is being conveyed so that a combined superposed color toner image is formed on the intermediate transfer belt 52.

One of feeding rollers 72 of the feeding table 71 is selected to be rotated so that a sheet S is sent from one of feeding cassettes 73 and is conveyed by conveying rollers 74 to the resist roller 75. Then, when the sheet S reaches the resist roller 75, there is a pause in the conveying of the sheet S. Then, the resist roller 75 is rotated at a timing of the combined color toner image on the intermediate transfer belt 52 so that the combined color toner image is transferred onto the sheet S at the second transfer device 59. The sheet S on which the combined color toner image is formed is further conveyed from the second transfer device 59 to the fixing device 32 where heat and pressure are applied to melt and fix the transferred combined color toner image on the sheet S.

Then, when forming images on both surfaces of the sheet S, the sheet S is conveyed on a sheet reversing path 23 and a two-way path 24 by a changeover claw 21 and a flip roller 22. Then, a combined color image toner is formed on the back surface of the sheet S by repeating the above described method.

When reversing and ejecting the sheet S, the sheet S is conveyed to the sheet reversing path 23 by the changeover claw 21, and then the sheet S is further conveyed to an ejecting roller 25 side by the flip roller 22 to reverse the front surface and the back surface of the sheet S.

When an image is formed only on one surface and reversing of the sheet S is not necessary, the sheet S is conveyed to the ejecting roller 25 by the changeover claw 21.

Subsequently, the ejecting roller 25 conveys the sheet S to the de-curl unit 26. The de-curl unit 26 includes a de-curl roller 27 and removes curling of the sheet S. The de-curl unit 26 changes the de-curl amount in accordance with the sheet S. The de-curl amount is adjusted by changing the pressure of the de-curl roller 27. Then, the sheet S is ejected from the de-curl roller 27. The purge tray 40 is provided below a sheet reversing unit such as the changeover claw 21, the flip roller 22 and the sheet reversing path 23.

(Correction of Image Size Based on Conveying Distance of the Sheet S)

The sheet conveying apparatus 100 measures the conveying distance "P" of the sheet S or the length "L" of the sheet S in the conveying direction of the sheet S by the above described method. Further, the sheet conveying apparatus 100 can measure the width of the sheet S in the direction (width direction) perpendicular to the conveying direction of the sheet S by contact image sensors (CISs), not shown in the drawings, positioned at edges of the sheet S, respectively.

After the conveying distance "P" of the sheet S or the sizes of the sheet S in the conveying direction and in the width direction are measured by the sheet conveying apparatus 100, the CISs or the like, a toner image is transferred onto the sheet S at the second transfer device 59. The sheet S on which the toner image is transferred is conveyed to the fixing device 32 where the toner image is fixed. There is a case where the sheet S is contracted by heat when passing through the fixing device 32.

Thereafter, the sheet S is reversed in the sheet reversing path 23 to be conveyed again to the sheet conveying apparatus 100. Then, the conveying distance "P" of the sheet S or the sizes of the sheet S in the conveying direction and in the width direction are measured again. Subsequently, a toner image is transferred and fixed on the back surface of the sheet S.

For a subsequent sheet S, the size or position of the toner image to be transferred on the back surface of the sheet S is corrected based on the ratio of expansion and contraction "R" of the measured sheet S. As a result, the size of the images to be formed on a front surface and a back surface of the sheet S are matched to improve the registration in two-sided printing.

The contraction of the sheet S after fixing recovers in accordance with time. Thus, by providing the sheet conveying apparatus 100 right before the second transfer device 59, the conveying distance "P" of the sheet S or the length "L" of the sheet S in the conveying direction is measured right before the toner image is transferred. With this structure, the ratio of expansion and contraction "R" can be accurately measured so that the registration in two-sided printing can be improved.

Correction of size of image based on the sheet size measured by the sheet conveying apparatus 100 is explained. As described above, in this embodiment, the sheet conveying apparatus 100 is provided right before the second transfer device 59, thus, the correction of the exposing data size or exposing timing based on the measured sheet size is not reflected on the sheet S for which the sheet size is measured, but reflected on a subsequent sheet S.

The exposure device 55 includes a data buffer unit that buffers input image data, an image data generating unit that generates image data for forming an image, an image size correction unit that corrects the size of the image data in the conveying direction of the sheet S based on the sheet size, a clock generating unit that generates a writing clock, and a light emitting device that forms an image by emitting a light on the photoconductor drum 56.

The data buffer unit is composed by a memory or the like. The data buffer unit stores the input image data sent from a host apparatus such as a controller or the like, not shown in the drawings, at a transferring clock.

The image data generating unit generates the image data based on the writing clock sent from the clock generating unit and size correction data sent from the image size correction unit. Then, the light emitting device is controlled to be ON/OFF by drive data output from the image data generating unit while having a length corresponding to one cycle of a writing clock as one pixel.

The image size correction unit generates the size correction data based on the sheet size measured by the sheet conveying apparatus 100.

The clock generating unit is operated at high frequency which is a few times of the writing clock in order to change clock period, and performs an image correction such as a known technique called pulse width modulation. The clock generating unit generates the writing clock at a frequency basically corresponding to the speed of the image forming apparatus 103.

The light emitting device is composed of one or a combination of a diode laser, a diode laser array, a vertical cavity surface emitting laser and the like. The light emitting device irradiates light on the photoconductor drum 56 in accordance with the drive data to form the electrostatic latent image on the photoconductor drum 56.

A pre-fixed image, which is a toner image, formed on the sheet S is fixed on the sheet S at the fixing device 32 by being heated and pressed. The sheet S may be deformed by the heat or the pressure so that the length of the sheet S in the conveying direction of the sheet S may be changed by expansion and contraction. As a result, there may be caused a difference in position between an image forming region on the back surface and that of the front surface of the sheet S to have influence on quality of output images, and registration in two-sided printing (as the image on the front surface is deformed so as to be shifted from the image on the back surface). The fixing device 32 may separately perform heating and pressing, or may be a flash fixing type.

Thus, according to the image forming apparatus 103, size of image and the image forming region are changed in accordance with the measured sheet size to compensate for the deformation of the sheet S caused by the fixing device 32. With this structure, even when the sheet S is deformed, registration in two-sided printing of the sheet S can be improved.

The sheet size, including the deformation of the sheet S, is obtained from the sheet conveying apparatus 100. Further, the image forming apparatus 103 can perform only expanding, only reducing, or a combination of expanding and reducing based on the deformation of the sheet S.

In duplex printing, the sheet S is deformed when fixing the toner image formed on a front surface of the sheet S while the sheet S is conveyed with a first end of the sheet S in front. Thereafter, the sheet S is reversed in the sheet reversing path 23 of the image forming apparatus 103. Then, the sheet S is conveyed with a second end, opposite end of the first end, of the sheet S in front to be inserted into the fixing device 32. At this time, if the image forming region is not corrected, a back end of an image formed on the back surface of the sheet S is shifted from a back end of an image formed on the front surface of the sheet S to reduce registration in two-sided printing.

However, according to the image forming apparatus 103, as the size of image and the image forming region are corrected when forming an image on the back surface of the sheet S, the registration in two-sided printing of the sheet S can be improved.

(Peripheral Speeds of Rollers of the Second Transfer Apparatus and the Sheet Conveying Apparatus)

The relationship of the peripheral speeds of the second transfer opposing roller 60 and the second transfer roller 61 of the second transfer device 59, and the driven roller 13 and the drive roller 14 of the sheet conveying apparatus 100 is explained.

The sheet conveying apparatus 100 includes the driven roller 13, the drive roller 14, a motor (an example of the driving unit 20) and a one-way clutch (an example the driving force transmitting unit 22) provided between the drive roller 14 and the motor.

As described above, the drive roller 14 is rotated by the driving force by the motor via the driving force transmitting unit. The driven roller 13 is rotated in accordance with the rotation of the drive roller 14 with the sheet S interposed between the drive roller 14 and the driven roller 13.

The one-way clutch provided between the drive roller 14 and the motor transmits the driving force to the drive roller 14 in a conveying direction in which the drive roller 14 conveys the sheet S, and stops transmitting the driving force to the drive roller 14 in a direction which is opposite to the conveying direction by slipping.

The sheet conveying apparatus 100 receives the sheet S from the resist roller 75, and conveys the sheet S at a predetermined speed such that a front end of the sheet S is inserted into the second transfer device 59 at a predetermined timing. The speed of conveying the sheet S by the sheet conveying apparatus 100 is controlled by the speed of the drive roller 14.

The second transfer device 59 receives the sheet S from the sheet conveying apparatus 100 and further conveys the sheet S. The second transfer device 59 transfers the toner image onto a surface of the sheet S.

The second transfer device 59 includes the intermediate transfer belt 52, the second transfer roller 61, a motor that independently drives the intermediate transfer belt 52 and the second transfer roller 61 and a torque limiter provided between the second transfer roller 61 and the motor.

The torque limiter provided between the second transfer roller 61 and the motor transmits the driving force of the motor to the second transfer roller 61 within a range of a limited load torque and stops transmitting the driving force from the motor to the second transfer roller 61 when the load torque exceeds a predetermined value by slipping.

The sheet conveying apparatus 100 may include a contact control mechanism that is configured to control the driven roller 13 or the drive roller 14 so that the driven roller 13 and the drive roller 14 are apart from each other when the sheet S is not being conveyed and the driven roller 13 and the drive roller 14 are in contact with each other when the sheet S is being conveyed. Further, the second transfer device 59 may also include a contact control mechanism that is configured to control the second transfer roller 61 or the second transfer opposing roller 60 so that the second transfer roller 61 and the second transfer opposing roller 60 are apart from each other when the sheet S is not being conveyed and the second transfer roller 61 and the second transfer opposing roller 60 are in contact with each other when the sheet S is being conveyed.

The sheet conveying apparatus 100 is configured to output a driving force for driving the motor connected to the drive roller 14 at a peripheral (linear) speed "Va". When the sheet S is conveyed only by the sheet conveying apparatus 100, the one-way clutch transmits the driving force of the motor to the drive roller 14. At this time, as the drive roller 14 is being rotated at the peripheral speed "Va", the sheet S is also conveyed at the speed "Va".

In the second transfer device 59, the intermediate transfer belt 52 is rotated at a peripheral (linear) speed "Vb" (Vb>=Va), and the motor connected to the second transfer roller 61 outputs a driving force that causes the second transfer roller 61 to be rotated at a peripheral (linear) speed "Vc" (Vc>=Vb).

Here, slip torque "Ts" of the torque limiter provided between the second transfer roller 61 and the motor is set between load torque "To" when the intermediate transfer belt 52 and the second transfer roller 61 are apart from each other, and load torque "Tc" when the intermediate transfer belt 52 and the second transfer roller 61 are in contact with each other (To<Ts<Tc).

Thus, when the second transfer roller 61 is apart from the intermediate transfer belt 52, the load torque "To" of the torque limiter is less than the slip torque "Ts". Therefore, the torque limiter transmits driving force of the motor to the second transfer roller 61 so that the second transfer roller 61 is rotated at the peripheral speed "Vc". When the second transfer roller 61 is in contact with the intermediate transfer belt 52, the load torque "Tc" of the torque limiter exceeds the slip torque "Ts". Thus, the torque limiter stops transmitting the driving force from the motor to the second transfer roller 61 so that the second transfer roller 61 is rotated in accordance with the intermediate transfer belt 52 at the peripheral speed "Vb".

Under this situation, when the sheet S is conveyed by both the sheet conveying apparatus 100 and the second transfer device 59, the sheet S is conveyed at the peripheral speed "Vb" of the intermediate transfer belt 52, where the one-way clutch of the sheet conveying apparatus 100 slips to stop transmitting the driving force from the motor to the drive roller 14. Thus, at this time, the drive roller 14 is rotated in accordance with the sheet S, which is conveyed at the linear speed "Vb" with the driven roller 13.

With this structure, when the sheet S is passed from the sheet conveying apparatus 100 to the second transfer device 59 and the toner image is being transferred onto the sheet S, the sheet S is conveyed at a constant linear speed "Vb", which is the peripheral speed "Vb" of the intermediate transfer belt 52. By maintaining the sheet conveying speed while the toner image is being transferred, an abnormal image with such as banding or the like can be prevented from being generated, and the image forming apparatus 103 can form uniform images.

The peripheral speed "Va" of drive roller 14, the peripheral speed "Vb" of the intermediate transfer belt 52 and the peripheral speed "Vc" of the second transfer roller 61 may be defined as the following equation (5).

In this case, the above merit can be obtained.

$$Va=<Vb=<Vc \quad (5)$$

However, if the difference between the peripheral speed "Va" and the peripheral speed "Vb" or between the peripheral speed "Vb" and the peripheral speed "Vc" is large, a slipping amount of the one-way clutch or the torque limiter when conveying the sheet S becomes large and the service lifetime of the one-way clutch or the torque limiter is lowered by heat, abrasion or the like. Thus, the difference between these peripheral speeds may be preferably set smaller and may be set equal to each other. However, if the peripheral speeds of the drive roller 14, the intermediate transfer belt 52 and the second transfer roller 61 change due to environmental variation such as temperature and relative humidity or the like and become not to meet the equation (5), the conveying speed of the sheet S is varied when transferring the toner image onto the sheet S to cause size change of the toner image formed on the sheet S. Thus, predetermined margins may be provided between the peripheral speed "Va" and the peripheral speed "Vb", and between the peripheral speed "Vb" and the peripheral speed "Vc".

The peripheral speeds "Va", "Vb" and "Vc" may be defined by the following equations (6) and (7).

$$0.90Vb=<Va=<0.99Vb \quad (6)$$

$$1.001Vb=<Vc=<1.05Vb \quad (7)$$

Further, preferably, the peripheral speeds "Va", "Vb" and "Vc" may be defined by the following equations (8) and (9) in order to maintain the service lifetime of the one-way clutch or the torque limiter, and obtain the above described merit considering the environmental variation or the like.

$$0.95Vb=<Va=<0.99Vb \quad (8)$$

$$1.001Vb=<Vc=<1.02Vb \quad (9)$$

With the above structure, the sheet conveying speed of the sheet S when transferring the toner image can be maintained at a constant value so that an abnormal image with such as banding or the like can be prevented from being generated, and the image forming apparatus 103 can form uniform images on the sheet S.

Further, for an image forming apparatus in which a toner image is directly transferred from the photoconductor drum to the sheet S, the sheet conveying speed may be maintained at a constant value when transferring the toner image by a similar method as described above. In this case, the intermediate transfer belt 52 may correspond to the photoconductor drum, and the second transfer roller 61 may correspond to a transfer roller that transfers an image from the photoconductor drum to the sheet S.

Further, instead of the one-way clutch provided between the drive roller 14 and the motor of the sheet conveying apparatus 100, a torque limiter may be provided by which slip torque is set so that the drive roller 14 is rotated in accordance with the sheet S for both the sheet conveying apparatus 100 and the intermediate transfer belt 52 when the sheet S is being conveyed.

As described above, according to the sheet conveying apparatus 100 of the embodiment, the conveying distance "P" of the sheet S can be accurately calculated with a simple structure. For example, just by adding sensors or the like to a conventional apparatus including the sheet conveying unit, the conveying distance "P" of the sheet S and the length "L" of the sheet S in the conveying direction can be accurately calculated.

Further, since it is not necessary to newly add a conveying unit for conveying the sheet S, the conveying distance "P" of the sheet S can be accurately calculated with lower cost with a simple structure of the apparatus.

Further, by providing the rotary encoder 15 at the driven roller 13 or at the drive roller 14 that conveys the sheet S, slipping between the rollers and the sheet S, looseness or the like between other conveying units 16, or the like does not occur.

According to the image forming apparatuses 101, 102 and 103 including the sheet conveying apparatus 100 of the embodiment, the conveying distance "P" of the sheet S can be accurately calculated. Then, by correcting the size of the image or the like based on the calculated conveying distance "P" of the sheet S, the registration in two-sided printing can be improved.

According to the embodiment, a sheet conveying apparatus capable of accurately obtaining the conveying distance "P" of a sheet with a simple structure is provided.

The individual constituents of the pulse measuring unit 116 and the conveying distance calculation unit 117 of the sheet conveying apparatus 100 may be embodied by arbitrary combinations of hardware and software, typified by a CPU of an arbitrary computer, memory, a program loaded in the memory so as to embody the constituents illustrated in the drawings, storage units for storing the program such as a hard disk, and an interface for network connection. It may be understood by those skilled in the art that methods and devices for the embodiment allow various modifications.

Although a preferred embodiment of the sheet conveying apparatus has been specifically illustrated and described, it is to be understood that minor modifications may be made therein without departing from the spirit and scope of the invention as defined by the claims.

The present invention is not limited to the specifically disclosed embodiments, and variations and modifications may be made without departing from the scope of the present invention.

What is claimed is:

1. A sheet conveying apparatus comprising:

a sheet conveying unit that conveys a sheet including a drive roller which is driven to be rotated by a driving unit, a driven roller which is rotated in accordance with the drive roller while the sheet is interposed between the drive roller and the driven roller, and a rotary encoder provided on a rotational axle of one of the drive roller and the driven roller;

a conveying amount measuring unit that measures a conveying amount of the sheet conveyed by the sheet conveying unit by measuring the number of pulses generated by the rotary encoder as a rotation amount;

a first detection unit positioned downstream of the sheet conveying unit and detecting passing of a front end portion of the sheet downstream of the sheet conveying unit in a conveying direction of the sheet, the first detection unit being positioned apart from the drive roller and the driven roller not to overlap with the drive roller and the driven roller in the conveying direction, in a plan view;

a second detection unit positioned upstream of the sheet conveying unit and detecting passing of a rear end portion of the sheet upstream of the sheet conveying unit in the conveying direction of the sheet; and a conveying distance calculation unit that calculates a conveying distance of the sheet based on the measured result by the conveying amount measuring unit and the detected results detected by the first detection unit and the second detection unit, wherein the distance between the first detection unit and the drive roller and the driven roller is set based on a conveying speed of the sheet and a resonance frequency of the one of the drive roller and the driven roller to which the rotary encoder is provided such that the first detection unit is capable of detecting passing of the front end portion of the sheet after velocity turbulence generated by insertion of the sheet between the drive roller and the driven roller converges.

2. The sheet conveying apparatus according to claim 1, wherein the conveying distance calculation unit calculates the conveying distance of the sheet based on the conveying amount measured by the conveying amount measuring unit between a first time when the first detection unit detects passing of the front end portion of the sheet and a second time when the second detection unit detects passing of the rear end portion of the sheet.

3. The sheet conveying apparatus according to claim 1, wherein the one of the drive roller and the driven roller is made of metal.

4. The sheet conveying apparatus according to claim 3, wherein a length of the driven roller in a direction perpendicular to the conveying direction of the sheet is shorter than the minimum width of an expected sheet adaptable to the sheet conveying apparatus in the direction perpendicular to the conveying direction of the sheet.

5. The sheet conveying apparatus according to claim 1, wherein the first detection unit and the second detection unit are transmission or reflection optical sensors.

6. The sheet conveying apparatus according to claim 1, wherein the first detection unit and the second detection unit are positioned on a line parallel to the conveying direction of the sheet.

7. The sheet conveying apparatus according to claim 1, wherein the conveying distance calculation unit calculates a length of the sheet in the conveying direction of the sheet by adding a distance between the first detection unit and the second detection unit to the calculated conveying distance of the sheet.

8. The sheet conveying apparatus according to claim 1, wherein the conveying amount measuring unit measures the conveying amount of the sheet conveyed by the sheet conveying unit based on the rotation amount of one of the drive roller and the driven roller, and the conveying distance calculation unit calculates the conveying distance of the sheet based on the conveying amount measured by the conveying amount measuring unit within a period determined by detections made by the first detection unit and the second detection unit.

9. An image forming apparatus comprising:

a transfer unit that transfers a toner image onto a sheet; and the sheet conveying apparatus according to claim 1.

10. The image forming apparatus according to claim 9, wherein the sheet conveying apparatus is provided upstream of the transfer unit in the conveying direction of the sheet.

11. The image forming apparatus according to claim 9, wherein the conveying distance calculation unit calculates a length of the sheet in the conveying direction of the sheet by adding a distance between the first detection unit and the second detection unit to the calculated conveying distance of the sheet, and the image forming apparatus further comprising:

an image data generating unit that generates image data for forming an image; and an image size correction unit that corrects the size of the image data in the conveying direction of the sheet based on the length of the sheet measured by the sheet conveying apparatus.

12. The image forming apparatus according to claim 11, wherein the sheet conveying apparatus is configured to measure the length of the sheet after a toner image is formed on a front surface of the sheet by the transfer unit and before a toner image is formed on a back surface of the sheet in duplex printing, and wherein the image size correction unit is configured to correct the size of the image data in the conveying direction of the sheet for forming a toner image on a back surface of the sheet in duplex printing based on the length of the sheet measured by the sheet conveying apparatus.

13. The image forming apparatus according to claim 11, wherein the sheet conveying apparatus is configured to measure the length of a first sheet after a toner image is formed on a front surface of the first sheet by the transfer unit and before a toner image is formed on a back surface of the first sheet in duplex printing, and wherein the image size correction unit is configured to correct the size of the image data in the conveying direction of the sheet for forming a toner image on a back surface of a second sheet that is conveyed subsequent to the first sheet in duplex printing based on the length of the first sheet measured by the sheet conveying apparatus.

14. The image forming apparatus according to claim 9, further comprising:

a sheet length calculation unit that calculates a length of the sheet by adding a distance between the first detection unit and the second detection unit to the conveying distance of the sheet calculated by the conveying distance calculation unit.

15. The sheet conveying apparatus according to claim 1, wherein the distance between the first detection unit and the drive roller and the driven roller is set such that the first detection unit is capable of detecting passing of the front end portion of the sheet after velocity turbulence generated by insertion of the sheet between the drive roller and the driven roller converges.

16. A sheet conveying distance calculation apparatus, comprising:

a conveying amount measuring unit that measures a conveying amount of the sheet conveyed by a sheet conveying unit, the sheet conveying unit including a drive roller which is driven to be rotated by a driving unit, a driven roller which is rotated in accordance with the drive roller while the sheet is interposed between the drive roller and the driven roller, and a rotary encoder provided on a rotational axle of one of the drive roller and the driven roller;

a first detection unit positioned downstream of the sheet conveying unit and detecting passing of a front end portion of the sheet downstream of the sheet conveying unit in a conveying direction of the sheet;

a second detection unit positioned upstream of the sheet conveying unit and detecting passing of a rear end portion of the sheet upstream of the sheet conveying unit in the conveying direction of the sheet; and a conveying distance calculation unit that calculates a conveying distance of the sheet based on the measured result by the conveying amount measuring unit and the detected results detected by the first detection unit and the second detection unit, wherein the conveying amount measuring unit measures the number of pulses generated by the rotary encoder as a rotation amount, wherein the first detection unit is positioned apart from the drive roller and the driven roller not to overlap with the drive roller and the driven roller in the conveying direction, in a plan view, and wherein the distance between the first detection unit and the drive roller and the driven roller is set based on a conveying speed of the sheet and a resonance frequency of the one of the drive roller and the driven roller to which the rotary encoder is provided such that the first detection unit is capable of detecting passing of the front end portion of the sheet after velocity turbulence generated by insertion of the sheet between the drive roller and the driven roller converges.

17. A sheet length calculation apparatus, comprising:

a conveying amount measuring unit that measures a conveying amount of the sheet conveyed by a sheet conveying unit, the sheet conveying unit including a drive roller which is driven to be rotated by a driving unit, a driven roller which is rotated in accordance with the drive roller while the sheet is interposed between the drive roller and the driven roller, and a rotary encoder provided on a rotational axle of one of the drive roller and the driven roller;

a first detection unit positioned downstream of the sheet conveying unit and detecting passing of a front end portion of the sheet downstream of the sheet conveying unit in a conveying direction of the sheet;

a second detection unit positioned upstream of the sheet conveying unit and detecting passing of a rear end portion of the sheet upstream of the sheet conveying unit in the conveying direction of the sheet; and a sheet length calculation unit that calculates a length of the sheet by adding a distance between the first detection unit and the second detection unit to a conveying distance of the sheet calculated based on the measured result by the conveying amount measuring unit and the detected results detected by the first detection unit and the second detection unit, wherein the conveying amount measuring unit measures the number of pulses generated by the rotary encoder as a rotation amount, wherein the first detection unit is positioned apart from the drive roller and the driven roller not to overlap with the drive roller and the driven roller in the conveying direction, in a plan view, and wherein the distance between the first detection unit and the drive roller and the driven roller is set based on a conveying speed of the sheet and a resonance frequency of the one of the drive roller and the driven roller to which the rotary encoder is provided such that the first detection unit is capable of detecting passing of the front end portion of the sheet after velocity turbulence generated by insertion of the sheet between the drive roller and the driven roller converges.

* * * * *